US007427427B1

(12) United States Patent
Montemurro

(10) Patent No.: US 7,427,427 B1
(45) Date of Patent: Sep. 23, 2008

(54) METHOD FOR STRIPING A SURFACE WITH PAINT AND APPARATUS THEREFOR

(76) Inventor: Michael Montemurro, 5701 Chretien Point Dr., Charlotte, NC (US) 28270

( * ) Notice: Subject to any disclaimer, the term of this patent is extended or adjusted under 35 U.S.C. 154(b) by 803 days.

(21) Appl. No.: 11/041,490

(22) Filed: Jan. 24, 2005

Related U.S. Application Data

(62) Division of application No. 10/834,514, filed on Apr. 29, 2004, now Pat. No. 6,866,716.

(60) Provisional application No. 60/493,201, filed on Aug. 7, 2003.

(51) Int. Cl.
*B05D 5/00* (2006.01)
*B05D 1/40* (2006.01)

(52) U.S. Cl. ..... 427/286; 427/256; 427/287

(58) Field of Classification Search ..... 427/256, 427/286, 287; 118/211, 244, 259; 401/208, 401/218, 193
See application file for complete search history.

(56) References Cited

U.S. PATENT DOCUMENTS 1,947,714 A * 2/1934 Harmon ..... 401/180
2,041,022 A * 5/1936 Rassmussen ..... 401/176
6,607,596 B2 * 8/2003 Grant ..... 118/211
6,789,974 B2 * 9/2004 Atkinson et al. ..... 401/208
6,953,298 B2 * 10/2005 Healy ..... 401/193
7,293,929 B1 * 11/2007 Atkinson et al. ..... 401/208

* cited by examiner

*Primary Examiner*—Frederick J Parker
(74) *Attorney, Agent, or Firm*—Ted Masters

(57) ABSTRACT

A tool and method for painting pinstripes on vehicles or other objects includes a wheel which cooperates with a paint reservoir. As the wheel is rolled along a surface, the wheel picks up paint from the reservoir and deposits it upon the surface. The wheel has rounded edges to prevent damage to the surface being striped. The tool has a rectangular shape which prevents it from rotating in the hand of the user, and has a slim transverse profile so that a pinstripe may be placed close underneath an obstruction such as a side view mirror. The guide bar of the present invention, which cooperates with a magnetic guide strip, is flat and has a rounded distal end. As such, the guide bar provides a more positive fit in the groove of the magnetic guide strip, and also allows the tool to be turned substantially perpendicular to the surface being striped.

10 Claims, 7 Drawing Sheets

500
506
508
512
D
513
520
518
514
502
3
3
505

500
506
513
508
4
512
520
514
510
502
504
505

509

502
505

20
24
M
D1
38
9
36
49
26
48
51
46
10
44
50
40
52
42
22
28
32

20
24
26
49
36
38
48
52
50
22
34
30
32
7
7
28
32

22
29

20
26
36
38
40
11
50
22

39
38
39
36

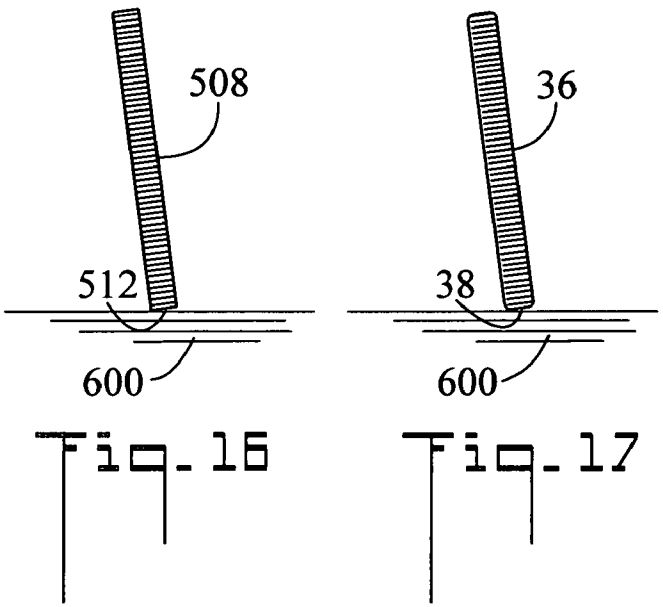
Fig-17
Fig-16
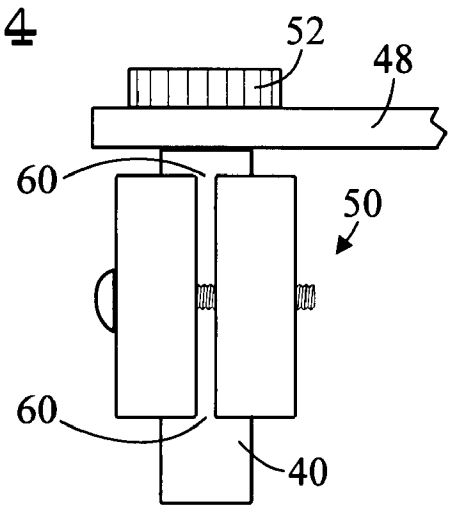
Fig-14
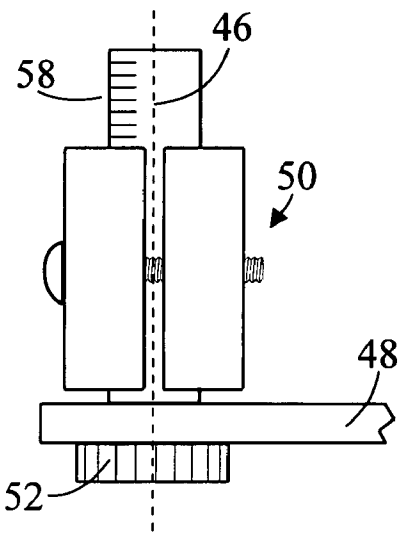
Fig-15

METHOD FOR STRIPING A SURFACE WITH PAINT AND APPARATUS THEREFOR

CROSS REFERENCE TO RELATED APPLICATION

This application is a Division of application Ser. No. 10/834,514, filed Apr. 29, 2004, U.S. Pat. No. 6,866,716 which claims benefit of 60/493,201 filed Aug. 7, 2003.

TECHNICAL FIELD

The present invention pertains generally to placing decorative pinstriping upon the surface of objects such as motor vehicles, and more particularly to a method and tool for accomplishing that task.

BACKGROUND OF THE INVENTION

Many people choose to have decorative pinstriping painted upon their automobiles, trucks, vans, SUVs, campers, and the like. Pinstriping can also be painted on furniture and other objects. Tools are often used to assist the artist in painting the long narrow pinstriping lines. For example U.S. Pat. No. 1,988,710 shows a striper for painting pinstriping lines. The striper comprises a barrel or tube adapted to contain paint. The barrel has an end closure which is slotted to receive a rotatable wheel plate. In operation, the paint or lacquer is place in the barrel and the wheel is rotated in engagement with the surface to be striped. The paint is carried by the capillary or viscosity action along the periphery of the wheel which applies it to the surface. This device has been in continuous use since 1935, and may be obtained from Beugler Inc., 3667 Tracy St. Los Angeles, Calif. 90039.

BRIEF SUMMARY OF THE INVENTION

The present invention is directed to an improved tool for applying stripes of paint (pinstripes) to vehicles or other objects. The present invention has some feature in common with the striper of U.S. Pat. No. 1,988,710, however the present invention includes several new features which improve the pinstriping process.

The guide bar of the present invention does not have and offset, and therefore the tool of the present invention can place a stripe close under an obstruction such as a side view mirror. Additionally, better fit and ease of manipulation is achieved with the rectangle body shape of the present invention as opposed to the round tube of the prior art design device which can slip in a user's hand during the application of a pinstripe.

The clamping mechanism of the present invention also solves a key holing problem of the prior art device. The present invention employs a transverse rectangular bar which is clamped to the body of the tool. Because the bar is rectangular, key holing cannot occur. The guide bar of the present invention is then connected to the transverse bar.

Additionally, the wheel of the present invention has rounded edges. Therefore damage to the surface being striped is mitigated when the wheel is inadvertently rolled on an edge.

The guide bar of the present invention does not have a circular cross section, but rather is flat and has a rounded distal end. As such, the guide bar provides a more positive fit in the groove of the magnetic guide strip, and also allows the tool to be turned substantially perpendicular to the surface being striped.

In accordance with a preferred embodiment of the invention, a tool for striping a surface with paint includes a body having a longitudinal axis, a first end, an opposite second end, and an internal cavity. A plunger is movable within the internal cavity along the longitudinal axis, the plunger being connected to a plunger rod which is slidably received by the second end. The plunger, the first end, and the internal cavity therebetween form a reservoir for receiving paint. A wheel having a toothed rim is disposed at the first end. As the wheel is rotated along a surface, the rim rotatably enters the reservoir and picks up paint therefrom, and then deposits the paint upon the surface in the form of a pinstripe.

A transverse bar having a first end, an opposite second end, a rectangular cross section, and a bar longitudinal axis, is connected to the body so that the bar longitudinal axis is perpendicular to the longitudinal axis of the tool. The transverse bar is selectively slidable with respect to the body along the bar longitudinal axis. A guide bar is connected to the first end of the transverse bar, wherein when the transverse bar is moved along the bar longitudinal axis, a distance between the guide bar and the body changes.

In accordance with an aspect of the invention the transverse bar can be moved by applying finger pressure to either its first end or the second end.

In accordance with another aspect of the invention, the transverse bar has a square cross section.

In accordance with another aspect of the invention, the transverse bar has a scale disposed along its bar longitudinal axis.

In accordance with another aspect of the invention, the body has a square hole for receiving the transverse bar. Circular holes are disposed at the four corners of the square hole.

In accordance with another aspect of the invention, the transverse bar may be installed from either end of the square hole.

In accordance with another aspect of the invention, the rim of the wheel has a midpoint. The guide bar has an outermost boundary which is disposed furthest from the body. The midpoint and the outermost boundary define a distance perpendicular to the longitudinal axis. The transverse bar may be positioned so that this distance is about 10 millimeters In accordance with another aspect of the invention, the edges of the rim are rounded.

In accordance with another aspect of the invention, the body of the tool has a rectangular cross section.

In accordance with another aspect of the invention, the guide bar is flat having a rectangular cross section and a rounded distal end.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 14 is the view of FIG. 12 with the transverse bar moved to the opposite side of the tool;

FIG. 15 is a view of FIG. 12 showing a scale disposed on the transverse bar;

FIG. 16 is an enlarged front elevation view of a prior art wheel;

FIG. 17 is an enlarged front elevation view of the wheel of the present invention;

DETAILED DESCRIPTION OF THE INVENTION

Figures 1, 2, 3, 4:
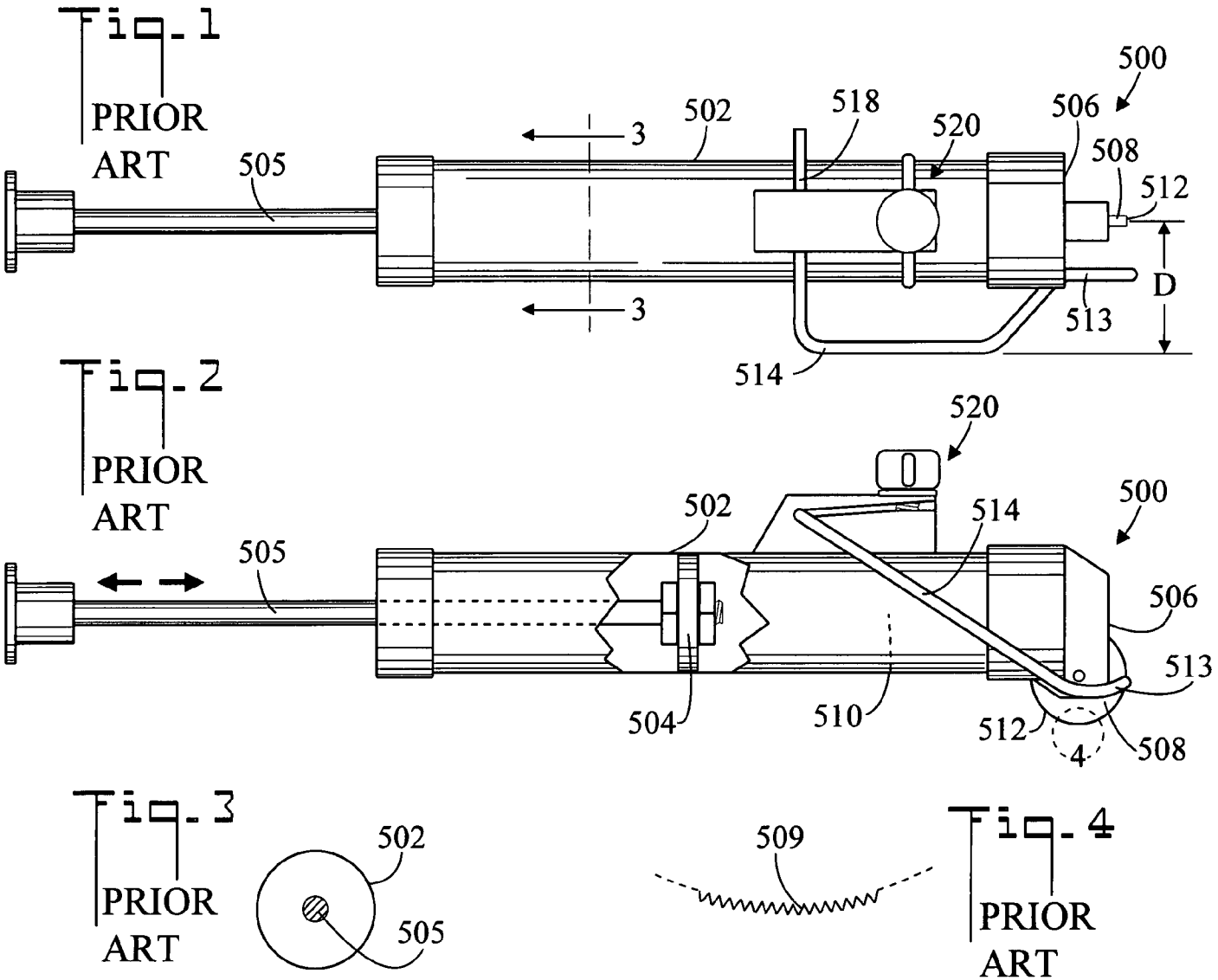
Fig. 1 PRIOR ART
Fig. 2 PRIOR ART
Fig. 4 PRIOR ART
Fig. 3 PRIOR ART
FIG. 1 is a top plan view of a prior art striper.
FIG. 2 is a breakaway side elevation view of the striper.
FIG. 3 is a cross sectional view along the line 3-3 of FIG. 1.
FIG. 4 is an enlarged fragmented view of area 4 of FIG. 2.

Referring initially to FIGS. 1 and 2, there are illustrated top plan and side elevation views respectively of a prior art striper for pinstriping vehicles or other objects, generally designated as 500. The shown striper 500 is a contemporary version of the striper disclosed in U.S. Pat. No. 1,988,710 and is used extensively in the pinstriping business. Striper 500 includes a cylindrical body or barrel 502. A plunger 504 is movable within body 502 by a plunger rod 505 (also refer to FIG. 3). A head 506 containing a wheel 508 is located at one end of body 502. Paint is loaded into a reservoir 510 in body 502 between plunger 504 and wheel 508. As paint is expended, plunger rod 505 is moved toward head 506 to move the paint toward wheel 508. It may be appreciated that as plunger 504 is moved along body 502, the size of reservoir 510 changes. As wheel 508 is rolled across the surface of an object, paint is picked up by wheel 508 from reservoir 510 by capillary action and then deposed upon the surface being striped. The rim 512 of wheel 508 has teeth 509 to pick up the paint (refer also to FIG. 4). It is also noted that wheel 512 is made of metal and can scratch the surface being striped if wheel 512 is inadvertently turned on edge during the striping process.

Striper 500 also includes a circular cross section guide bar 514 which is used to guide the striping process. The distal end 513 of guide bar 514 is inserted into a slot in a magnetic guide strip 516 which is placed on the surface 600 being striped (refer to FIGS. 18 and 19). Striper 500 is moved along magnetic guide strip 516 to effect the striping process. It is noted that guide bar 514 outwardly projects a distance D from body 502. The proximal end 518 of guide bar 514 is held in place by a clamping mechanism 520. In the shown view, distance D is the minimum distance that can be achieved in view of the need to employ the magnetic guide strip 516, and is about 20 millimeters. Because the cross section of guide bar 514 is circular, over time clamping mechanism 520 can be damaged by a process known as "key holing". Eventually the key holing prevents guide bar 514 from being properly clamped, and therefore necessitates a total replacement of tool 500.

FIG. 3 is a cross sectional view along the line 3-3 of FIG. 1 showing body 502, and plunger rod 505.

FIG. 4 is an enlarged fragmented view of area 4 of FIG. 2 showing the teeth 509 of rim 512 of wheel 508.

Figures 5, 6, 7, 8, 9:
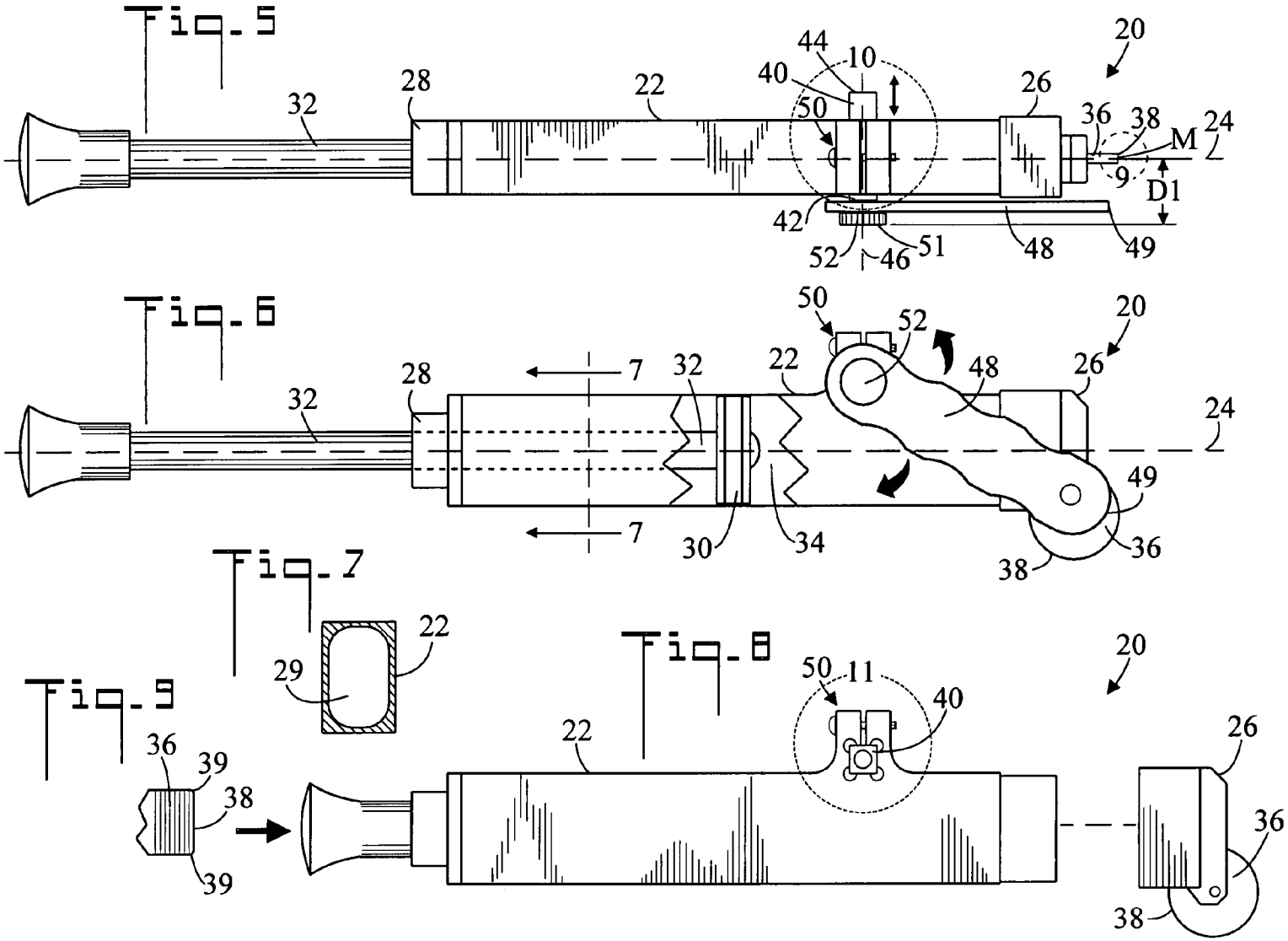
FIG. 5 is a top plan view of a tool for striping a surface with paint in accordance with the present invention.
FIG. 6 is a breakaway side elevation view of the tool.
FIG. 7 is a cross sectional view along the line 7-7 of FIG. 6.
FIG. 8 is an exploded side elevation view of the tool.
FIG. 9 is an enlarged fragmented view of area 9 of FIG. 5.
Figure 25:
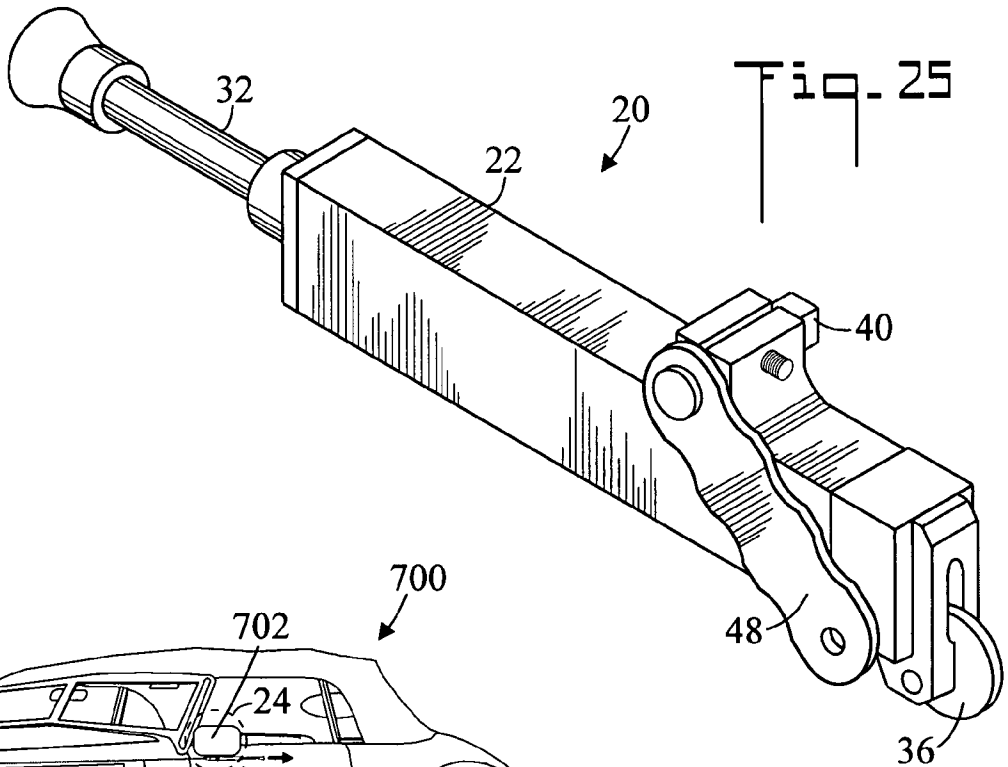
FIG. 25 is a perspective view of the tool.

Now referring to FIGS. 5, 6, and 25 there are illustrated top plan, side elevation, and perspective views respectively of a tool for striping a surface with paint in accordance with the present invention, generally designated as 20. Tool 20 includes a body 22 having a longitudinal axis 24, a first end 26 comprising a removable head, an opposite second end 28, and an internal cavity 29 (refer to FIG. 7). Body 22 has a rectangular cross section (refer also to FIG. 7). The rectangular cross section prevents tool 22 from rotating or rolling in the hand of a user. Also the flat sides of tool 20 facilitate the orientation of tool 20 with respect to the surface being striped. That is, the flat sides of tool 20 serve as a visual guide in keeping tool 20 perpendicular to the surface. Both of these factors are important in keeping the rim of the paint-dispensing wheel of tool 20 flat against the surface.

Tool 20 further includes a plunger 30 which is movable within internal cavity 29 along longitudinal axis 24. Plunger 30 is connected to a plunger rod 32 which is slidably received by second end 28. Plunger 30 and first end 26 form ends of a reservoir 34 for receiving paint, lacquer, or the like. In other words, the portion of internal cavity 29 between plunger 30 and first end 26 comprises reservoir 34, the size of which will change as a function of the position of plunger 30. In an embodiment of the invention, urethane paint is utilized to stripe the surface of a motor vehicle. A wheel 36 having a toothed rim 38 (also refer to FIG. 9) is disposed at first end 36, rim 38 rotatably entering reservoir 34 and receiving paint therefrom, so that as rim 38 is rolled along a surface 600 a stripe of paint is disposed thereon (also refer to FIGS. 18 and 19). A transverse bar 40 having a first end 42, an opposite second end 44, a rectangular cross section (which is square in the shown embodiment), and a bar longitudinal axis 46, is connected to body 22 so that bar longitudinal axis 46 is perpendicular to longitudinal axis 24. Transverse bar 40 is selectively slidably with respect to body 22 along bar longitudinal axis 46. A guide bar 48 is rotationally connected to first end 42 of transverse bar 40, wherein when transverse bar 40 is moved along bar longitudinal axis 46, a distance between guide bar 48 and body 22 changes. It is further noted that guide bar 48 has a rectangular cross section and a rounded distal end 49. In an embodiment of the invention guide bar 48 is flat and has a thickness of about 1/16 of an inch.

Referring to FIG. 5, rim 38 of wheel 36 has a midpoint. Guide bar 48 has an outside boundary 51 which is disposed furthest from body 22. In the shown embodiment, thumb screw 52 which holds guide bar 48 to transverse bar 40 is considered to be part of guide bar 48 and defines outside boundary 51. Thumb screw 52 is tightened to prevent guide bar 40 from rotating about transverse bar 40. The midpoint M and the outside boundary 51 define a distance D1 perpendicular to longitudinal axis 24. In the shown embodiment guide bar 48 has been positioned to a minimum distance which is about 10 millimeters. It is noted that the minimum distance D1 (10 mm) of the present invention is less than the minimum distance D (20 mm) of the prior art striper. As such the during the striping operation, the tool 20 of the present invention can be brought closer under an obstruction than can the prior art device (refer also to FIGS. 23 and 24).

FIG. 7 is a cross sectional view along the line 7-7 of FIG. 6 showing the rectangular cross section of body 22.

FIG. 8 is an exploded side elevation view of the tool showing first end 26 (head) removed and plunger rod 32 fully inserted. In this view, guide bar 48 has been removed. Paint may be loaded into tool 20 by removing first end 26 (head) as is shown in FIG. 8.

FIG. 9 is an enlarged fragmented view of area 9 of FIG. 5 showing wheel 36 and wheel rim 38. It is noted that rim 38 has rounded edges 39. This feature of the present invention mitigates against scratching the surface being striped should wheel 36 be inadvertently turned on edge during the striping process (refer also to FIGS. 16 and 17). In another possible embodiment of the present invention, wheel 36 is fabricated from a non-metal such as fiberglass having a solvent proof resin base or a polymer. As such wheel 36 will not scratch the surface being striped even if wheel 36 is inadvertently turned on edge during the striping process.

Figure 10:
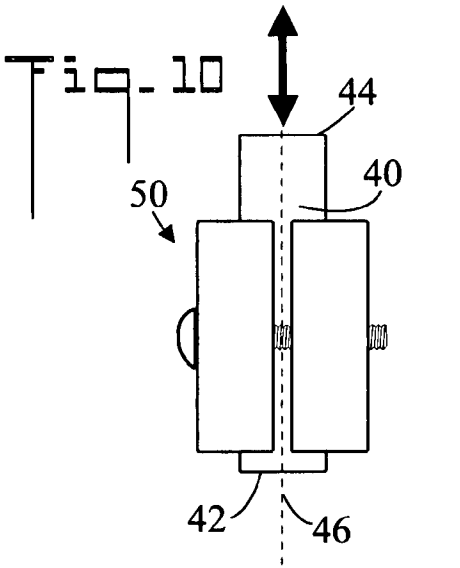
FIG. 10 is an enlarged view of area 10 of FIG. 5.

FIG. 10 is an enlarged view of area 10 of FIG. 5 showing transverse bar 40 which is movable in either direction along transverse bar axis 46. Clamping mechanism 50 (a screw in the shown embodiment) is adjusted so that transverse bar 40 will remain in a desired position during the striping operation, but also so that transverse bar 40 is movable by finger pressure exerted upon either first end 42 or second end 44.

Figure 11:
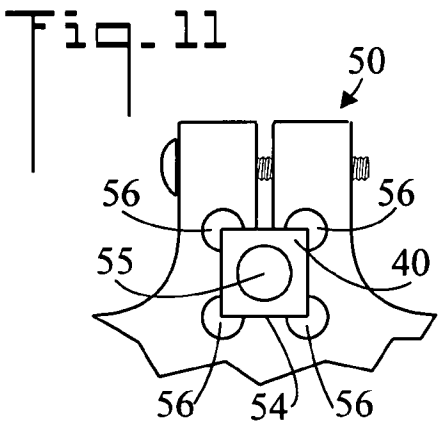
FIG. 11 is an enlarged view of area 11 of FIG. 8.

FIG. 11 is an enlarged view of area 11 of FIG. 8 with guide bar 48 removed. Body 22 has a rectangular hole 54 (square in the shown embodiment) for receiving transverse bar 40. A threaded hole 55 in the end of transverse bar 40 receives thumb screw 52 (refer to FIGS. 12 and 13) which is used to fixedly hold guide bar 48 to transverse bar 40. A unique feature of the invention is found in the way transverse bar 40 is held in place by clamping mechanism 50. Square hole 54 has circular holes 56 disposed at its four corners. This reduces the surface area brought to bear against transverse bar 40 by clamping mechanism 50, and therefore allows transverse bar 40 to be moved along transverse bar axis 46 by finger pressure.

Figure 12:
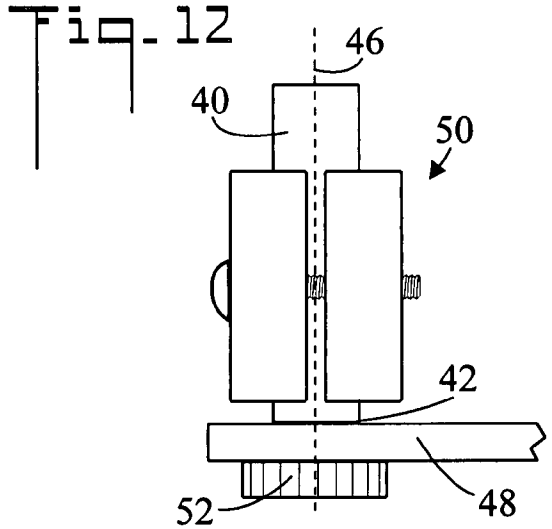
FIG. 12 is an enlarged view of area 10 of FIG. 5 and includes a fragmented view of a guide bar.

FIG. 12 is an enlarged view of area 10 of FIG. 5 and further including a fragmented view of a guide bar 48. Transverse bar 40 is held in place by clamping mechanism 50 with guide bar 48 connected to first end 42 of transverse bar 40 by thumb screw 52.

Figure 13:
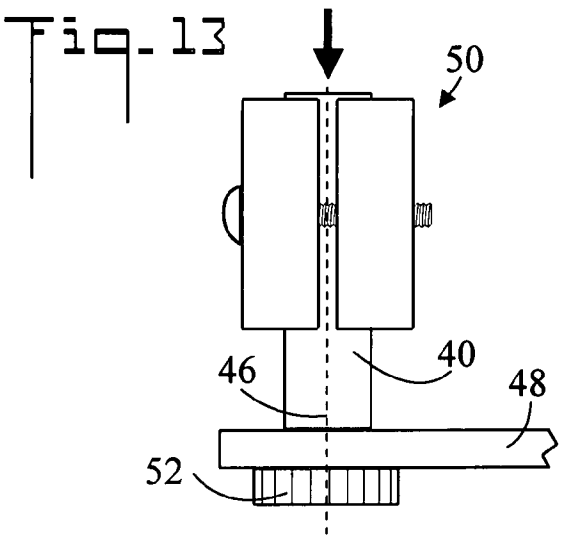
FIG. 13 is the view of FIG. 12 with a transverse bar moved to a different position.

FIG. 13 is the view of FIG. 12 with transverse bar 40 moved to a different position along longitudinal axis 46. Moving transverse bar 40 also moves guide bar 48 with respect to clamping mechanism 50 of body 22.

FIG. 14 is the view of FIG. 12 with transverse bar 40 moved to the opposite side of tool 20. Square hole 54 has a first end 60 and an opposite second end 62. Transverse bar 40 is installable in square hole 54 from either first end 60 or second end 62. This position of transverse bar 40 is useful for a left handed person.

FIG. 15 is a view of FIG. 12 showing a scale 58 disposed on the transverse bar, the scale 58 being disposed along longitudinal axis 46. Scale 58 is useful in transversely positioning guide bar 48 with respect to clamping mechanism 50 of body 22 by moving transverse bar 40. Scale 58 is particularly useful in placing side-by-side stripes. For example the first stripe is placed with scale 58 in one position with respect to clamping mechanism 50, and to place the second stripe transverse bar 40 is moved so that scale 58 is in another position with respect to clamping mechanism 50 (for example two scale divisions away).

FIG. 16 is an enlarged front elevation view of prior art wheel 508 which has been turned on edge. The sharp edges of rim 512 can cause an undesirable scratch in surface 600.

FIG. 17 is an enlarged front elevation view of wheel 36 of the present invention. Here also wheel 36 has been turned on edge, however since the edges of wheel 36 are rounded, a scratch will not occur (refer also to FIG. 9 and the discussion pertaining thereto).

Figure 18:
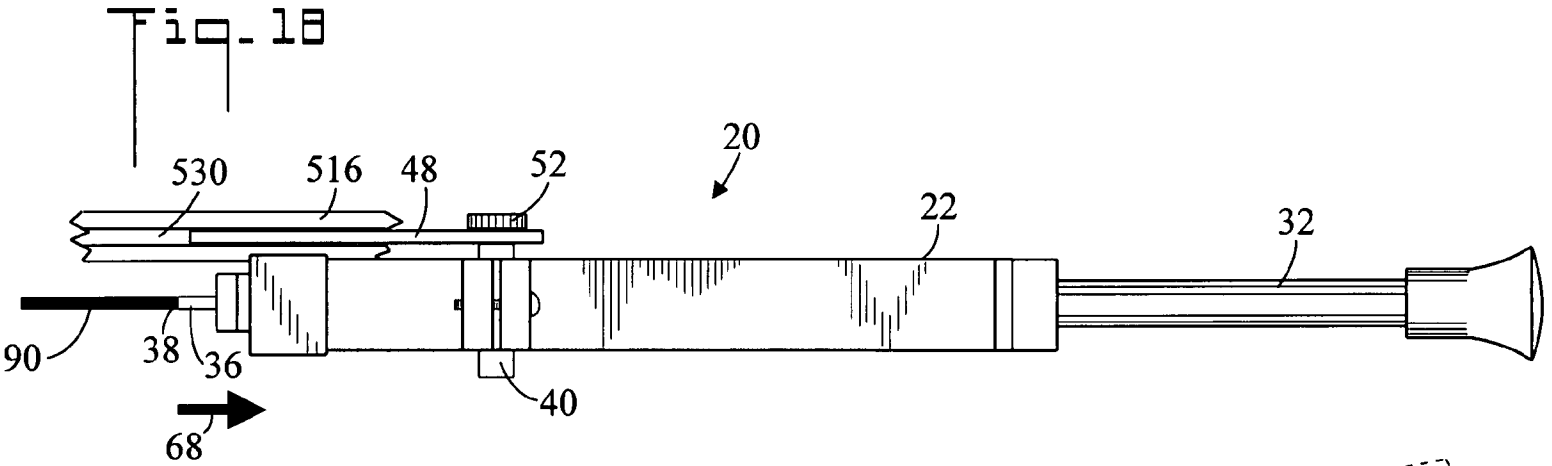
FIG. 18 is a top plan view of the tool marking a stripe on a surface.
Figure 19:
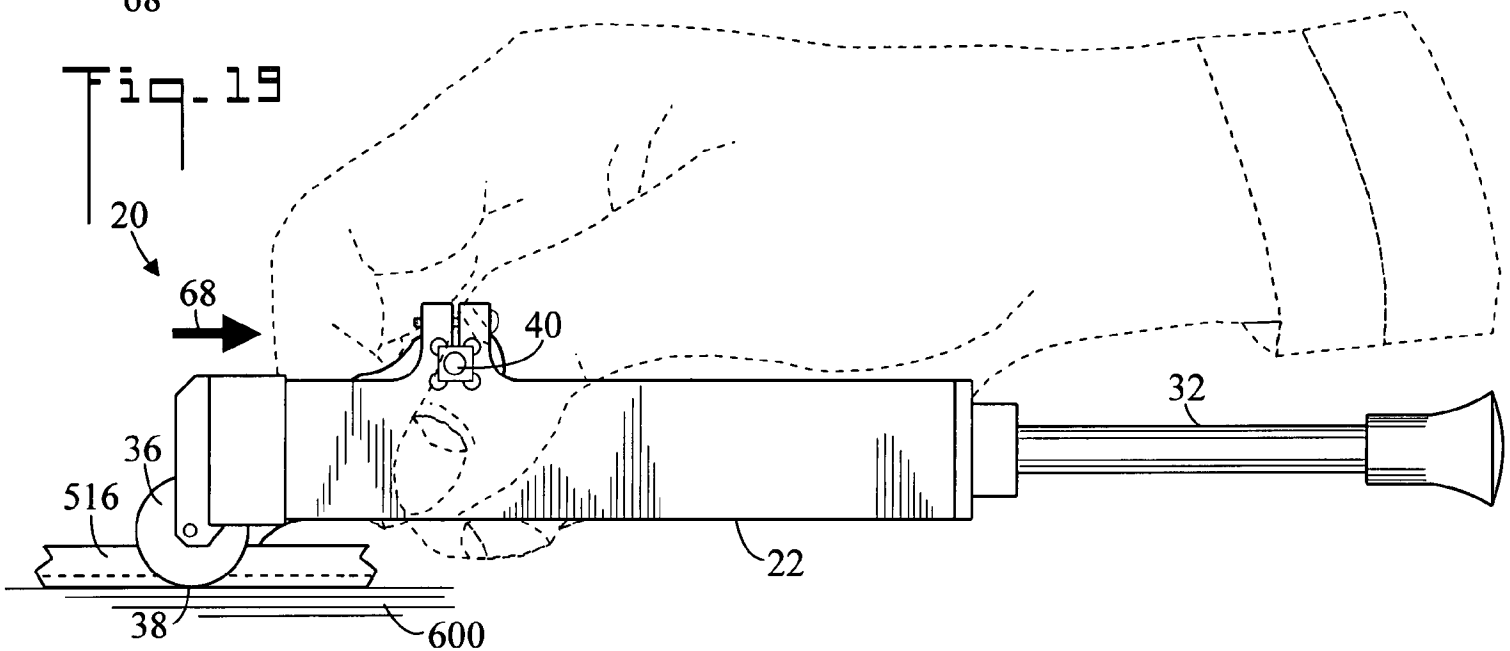
FIG. 19 is a side elevation view of the tool marking the stripe, and also showing how the tool held in the hand of a user.

FIG. 18 is a top plan view of tool 20 marking a stripe 90 on a surface 600, and FIG. 19 is a side elevation view of tool 20 marking the stripe, and also showing how tool 20 held in the hand of a user. Tool 20 is positioned with guide bar 48 residing in longitudinal groove 530 of magnetic guide strip 516 which as been positioned parallel to where stripe 90 is to be placed (also refer to FIGS. 20 and 21). Tool 20 is pulled by the hand of the user in direction 68 to make stripe 90. In practice magnetic guide strip 516 can be positioned along surface 600 by utilizing a thin strip of masking tape (not shown).

Figure 20:
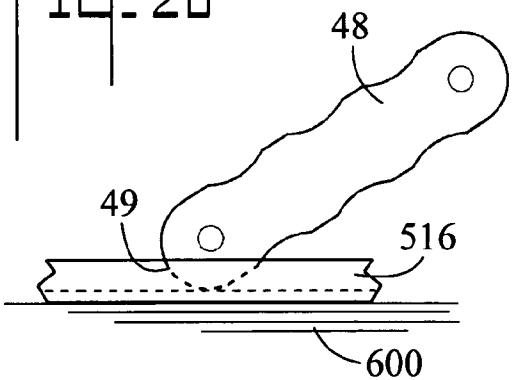
FIG. 20 is a side elevation view of a guide bar and magnetic guide strip.
Figure 21:
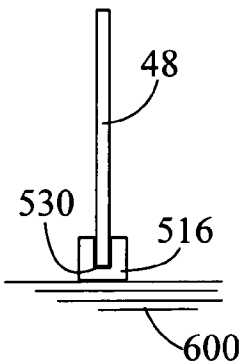
FIG. 21 is a front elevation view of the guide bar and magnetic guide strip.

FIGS. 20 and 21 are side elevation and front elevation views respectively of guide bar 48 and magnetic guide strip 516. Since guide bar 48 has a rectangular cross section (is flat), it engages a larger portion of groove 530 than does circular guide bar 514 of the prior art striper (refer to FIGS. 1 and 2). As such, guide bar 48 of the present invention is more positively held in place by magnetic guide strip 516 and less likely to leave groove 530 during the striping process. Additionally because distal end 49 of guide bar 48 is rounded, guide bare 48 may be oriented at various angles with respect to surface 600 (refer to FIGS. 19-20 where guide bar 48 is oriented at about 30 degrees, and to FIG. 22 where guide bar 48 is substantially perpendicular to surface 600).

Figure 22:
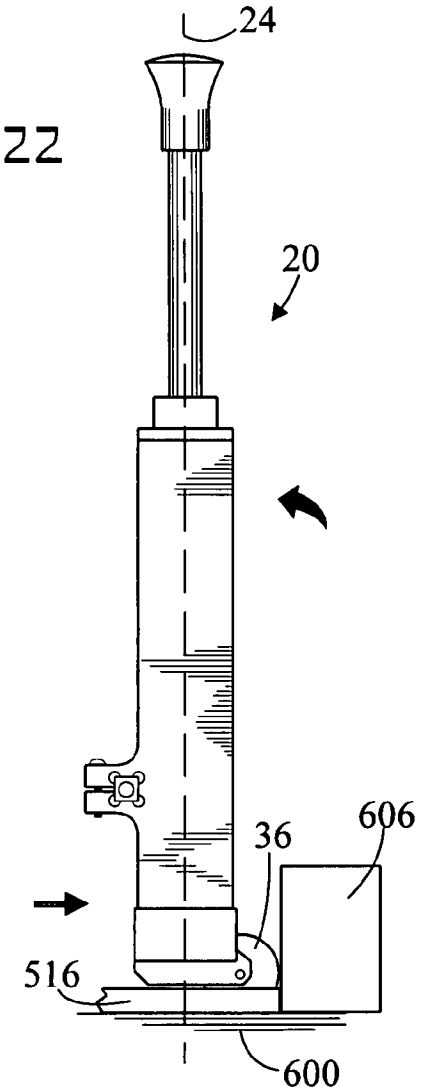
FIG. 22 is a reduced side elevation view of the tool rotated to be substantially perpendicular to the surface being striped.

FIG. 22 is a reduced side elevation view of tool 20 rotated to be substantially perpendicular to the surface 600 being striped. This procedure is useful when an end obstruction 606 is encountered. Because of the flat design of guide bar 48 and its rounded distal end 49, just before the obstruction 606 is encountered, thumb screw 52 is released, guide bar 48 rotated to be substantially parallel with longitudinal axis 24, and thumb screw 52 retightened. Stripe 90 may them be placed within one-half of a wheel 36 diameter of obstruction 606. This maneuver is not possible with the prior art device 500 because the guide bar 514 of that device has a circular cross section and as such will rotate in groove 530 of magnetic guide strip 516 when the tool is turned perpendicular to surface 600. If guide bar 514 rotates it does not guide the tool in a straight line and therefore it is not possible to paint a straight stripe.

Figure 23:
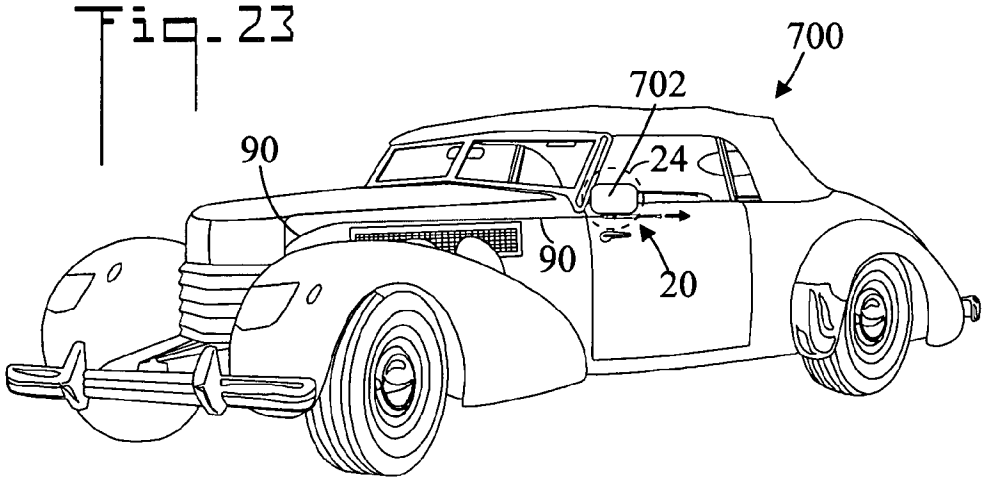
FIG. 23 is a reduced perspective view of an automobile being striped with the present invention.

FIG. 23 is a reduced perspective view of an automobile 700 being striped with the present invention. In order to paint a straight pinstripe, the pinstripe must pass as close as possible under the side view 702 mirror. A strip 90 is being placed from the front to the back of the automobile 700. Because of the design of the present invention (refer to FIG. 5 and the discussion pertaining thereto) the strip 90 may be placed very close under an obstruction such as the side view mirror 702. This feature is very important on vehicles where the pinstripe must be placed high on the body line.

Figure 24:
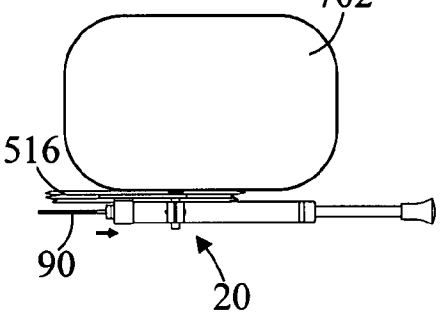
FIG. 24 is an enlarged view of area 24 of FIG. 23.

FIG. 24 is an enlarged view of area 24 of FIG. 23 showing how a pinstripe may be placed very close under an obstruction such as a side view mirror 702.

FIG. 25 is a perspective view of tool 20.

In terms of use, a method for striping a surface with paint includes:

(a) providing a surface 600 to be striped;

(b) providing paint;

(c) providing a tool 20 including:

a body 22 having a longitudinal axis 24, a first end 26, an opposite second end 28, and an internal cavity 29;

a plunger 30 movable within internal cavity 29 along longitudinal axis 24, plunger 30 connected to a plunger rod 32 which is slidably received by second end 28, plunger 30 and first end 28 forming ends of a reservoir 34 for receiving the paint;

a wheel 36 having a rim 38 disposed at first end 26, rim 38 rotatably entering reservoir 34, and when reservoir 34 is loaded with paint, rim 38 receiving paint therefrom;

a transverse bar 40 having a first end 42, an opposite second end 44, a rectangular cross section, and a bar longitudinal axis 46, transverse bar 40 connected to body 22 so that bar longitudinal axis 46 is perpendicular to longitudinal axis 24, transverse bar 40 selectively slidably with respect to body 22 along bar longitudinal axis 46;

a guide bar 48 rotatably connected to first end 42 of transverse bar 40; and, (d) loading reservoir 34 with paint;

(e) moving transverse bar 40 to a desired position along bar longitudinal axis 46; and, (f) rolling rim 38 of wheel 36 along surface 600 wherein a stripe of paint is disposed thereon.

The method further including:

in step (e), the moving effected by exerting finger pressure upon one of first end 42 and second end 44 of transverse bar 40.

The method further including:

in step (c), transverse bar 40 having a square cross section.

The method further including:

in step (c), transverse bar 40 having a scale 58 disposed along bar longitudinal axis 46; and, in step (e), using scale 58 to position transverse bar 40 to the desired position.

The method further including:

in step (c), transverse bar 40 having a scale 58 disposed along bar longitudinal axis 46; and, (g) using scale 58 to position transverse bar 40 to a second desired position; and, (h) again rolling rim 38 of wheel 36 along surface 600 wherein a second stripe of paint is disposed thereon, the second stripe being parallel to the stripe of paint.

The method further including:

in step (c), guide bar 40 having a rectangular cross section and a rounded distal end 49;

(g) providing a magnetic guide strip 516 having a longitudinal groove 530;

(h) prior to step (f) placing magnetic guide strip 516 on surface 600; and, (i) prior to step (f), inserting distal end 49 into longitudinal groove 530.

The method further including:

during step (f), orienting tool 20 so that longitudinal axis 24 is substantially perpendicular to surface 600 and observing that the stripe of paint is straight. (refer to FIG. 22).

The method further including:

in step (c), body 22 having a rectangular cross section; and, in step (f) the rectangular cross section (1) preventing tool 20 from rotating in a user's hand, and (2) facilitating the orientation of tool 20 with respect to surface 600.

The method further including:

in step (c), rim 38 of wheel 36 having a midpoint M, guide bar 48 having an outside boundary 51 disposed furthest from said body, midpoint M and outside boundary 51 defining a distance D1 perpendicular to longitudinal axis 24, and transverse bar 40 positionable in step (e) so that distance D1 is about 10 millimeters;

in step (a), an obstruction disposed upon surface 600; and, in step (f), rolling rim 38 of said wheel along surface 600 so that midpoint M of rim 38 passes within 10 millimeters of the obstruction.

The method further including:

in step (c), rim 38 having rounded edges 39; and, during step (f), inadvertently turning rim 38 on edge and observing that rim 38 does not scratch surface 600.

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for striping a surface with paint, comprising:

(a) providing a surface to be striped;

(b) providing paint;

(c) providing a tool including:

a body having a longitudinal axis, a first end, an opposite second end, and an internal cavity;

a plunger movable within said internal cavity along said longitudinal axis, said plunger connected to a plunger rod which is slidably received by said second end, said plunger and said first end forming ends of a reservoir for receiving said paint;

a wheel having a rim disposed at said first end, said rim rotatably entering said reservoir;

a transverse bar having a first end, an opposite second end, a rectangular cross section and a bar longitudinal axis, said transverse bar connected to said body so that said bar longitudinal axis is perpendicular to said longitudinal axis, said transverse bar selectively slidably with respect to said body along said bar longitudinal axis;

a guide bar connected to said first end of said transverse bar; and, (d) loading said reservoir with said paint;

(e) moving said transverse bar to a desired position along said bar longitudinal axis; and, (f) rolling said rim of said wheel along said surface wherein a stripe of said paint is disposed thereon.

2. The method of claim 1, further including:

in step (e), said moving effected by exerting finger pressure upon one of said first end and said second end of said transverse bar.

3. The method of claim 1, further including:

in step (c), said transverse bar having a square cross section.

4. The method of claim 1, further including:

in step (c), said transverse bar having a scale disposed along said bar longitudinal axis; and, in step (e), using said scale to position said transverse bar to said desired position.

5. The method of claim 1, further including:

in step (c), said transverse bar having a scale disposed along said bar longitudinal axis; and, (g) using said scale to position said transverse bar to a second desired position; and, (h) again rolling said rim of said wheel along said surface wherein a second stripe of paint is disposed thereon, said second stripe being parallel to said stripe of paint.

6. The method of claim 1, further including:

in step (c), said guide bar having a rectangular cross section and a rounded distal end;

(g) providing a magnetic guide strip having a longitudinal groove;

(h) prior to step (f) placing said magnetic guide strip on said surface; and, (i) prior to step (f), inserting said distal end into said longitudinal groove.

7. The method of claim 6, further including:

during step (f), orienting said tool so that said longitudinal axis is substantially perpendicular to said surface and observing that said stripe of paint is straight.

8. The method of claim 1, further including:

in step (c), said body having a rectangular cross section; and, in step (f) said rectangular cross section (1) preventing said tool from rotating in a user's hand, and (2) facilitating the orientation of said tool with respect to said surface.

9. The method of claim 1, further including:

in step (c), said rim of said wheel having a midpoint, said guide bar having an outside boundary disposed furthest from said body, said midpoint and said outside boundary defining a distance perpendicular to said longitudinal axis, and in step (e) said transverse bar positionable so that said distance is about 10 millimeters;

in step (a), an obstruction disposed upon said surface; and, in step (f), rolling said rim of said wheel along said surface so that said midpoint of said rim passes within 10 millimeters of said obstruction.

10. The method of claim 1, further including:

in step (c), one of (1) said rim having rounded edges, and (2) said wheel fabricated from a non-metal; and, during step (f), inadvertently turning said rim on edge and observing that said rim does not scratch said surface.

* * * * *